US010427283B2

(12) United States Patent
Shi

(10) Patent No.: US 10,427,283 B2
(45) Date of Patent: Oct. 1, 2019

(54) OIL FILTER REMOVER

(71) Applicant: TOP WELL TOOLS INDUSTRIAL CO., LTD., Taichung (TW)

(72) Inventor: Wen-Zhang Shi, Taichung (TW)

(73) Assignee: TOP WELL TOOLS INDUSTRIAL CO., LTD., Taichung (TW)

( * ) Notice: Subject to any disclaimer, the term of this patent is extended or adjusted under 35 U.S.C. 154(b) by 185 days.

(21) Appl. No.: 15/614,083

(22) Filed: Jun. 5, 2017

(65) Prior Publication Data

US 2018/0345465 A1 Dec. 6, 2018

(51) Int. Cl.
*B25B 27/00* (2006.01)
*B25B 13/50* (2006.01)
*B25B 17/00* (2006.01)

(52) U.S. Cl.
CPC ..... *B25B 27/0042* (2013.01); *B25B 13/5016* (2013.01); *B25B 17/00* (2013.01)

(58) Field of Classification Search
CPC ..... B25B 13/5016; B25B 13/46; B25B 17/00; B25B 27/0042
USPC ..... 81/90.2, 90.3
See application file for complete search history.

(56) References Cited

U.S. PATENT DOCUMENTS 9,114,508 B2 * 8/2015 Antonio ..... B25B 13/44
2012/0079919 A1 * 4/2012 Chen ..... B25B 27/0042 81/90.2
2016/0325417 A1 * 11/2016 Klamm ..... B25B 27/0042

FOREIGN PATENT DOCUMENTS

TW I369282 B 8/2012

* cited by examiner

*Primary Examiner* — Monica S Carter
*Assistant Examiner* — Makena S Markman
(74) *Attorney, Agent, or Firm* — Muncy, Geissler, Olds & Lowe, P.C.

(57) ABSTRACT

An oil filter remover includes a main body, a toothed element, three claw elements, and an elastic element. The main body has three first pivot portions and a first connecting portion between two adjacent first pivot portions. The toothed element is arranged at the center of the main body and is formed with an annular toothed portion. Each claw element has a bent clamping portion and a second pivot portion. The second pivot portions are pivotally connected to the first pivot portions respectively. Each claw element has a toothed portion to be engaged with the annular toothed portion respectively. One of the claw elements has a second connecting portion between the clamping portion and the second pivot portion. The elastic element is connected to the first connecting portion and the second connecting portion therebetween so that the claw elements tend to pivot toward the main body.

9 Claims, 5 Drawing Sheets

OIL FILTER REMOVER

BACKGROUND OF THE INVENTION

Field of the Invention

The present invention relates to an oil filter remover.

Description of the Prior Art

A conventional oil filter remover is disclosed in patent TW I369282. The oil filter remover includes a main body and three clamping elements. The main body has a rotatable toothed element, and each clamping element has a toothed portion to be engaged with the toothed element. Thus, when the toothed element is rotated, the clamping elements are pivoted inward or outward to enlarge or to narrow the clamping space.

However, the user has to use a tool, such as a wrench, to rotate the toothed element. Furthermore, the tool cannot be removed from the oil filter remover during the whole operation, and the user has to hold the tool tightly all the time. Thus, the oil filter remover is inconvenient and difficult to operate.

SUMMARY OF THE INVENTION

The main object of the present invention is to provide an oil filter remover which is easy to operate.

To achieve the above and other objects, an oil filter remover of the present invention includes a main body, a toothed element, at least three claw elements, and an elastic element.

The main body defines a center. The main body has at least three first pivot portions arranged spacedly at a periphery thereof. The main body further has at least one first connecting portion located between two adjacent ones of the first pivot portions. The toothed element is rotatably arranged at the center of the main body. The toothed element is formed with an annular toothed portion around a periphery thereof. The toothed element further has a driving portion for a tool to connect with. Each claw element has a bent clamping portion at an end thereof and a second pivot portion at an other end thereof. The second pivot portions are pivotally connected to the first pivot portions respectively. Each claw element has a toothed portion beside the second pivot portion. The toothed portions are engaged with the annular toothed portion respectively. At least one of the claw elements further has a second connecting portion located between the clamping portion and the second pivot portion. The clamping portions enclose a clamping space. Two opposite ends of the elastic element are connected to the first connecting portion and the second connecting portion respectively so that the claw elements tend to pivot toward the main body.

Thereby, the claw elements tend to pivot inward to clamp the oil filter, so the user doesn't have to fasten the claw elements all the time. As a result, operation becomes easier, and the claw elements are prevented from slipping.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
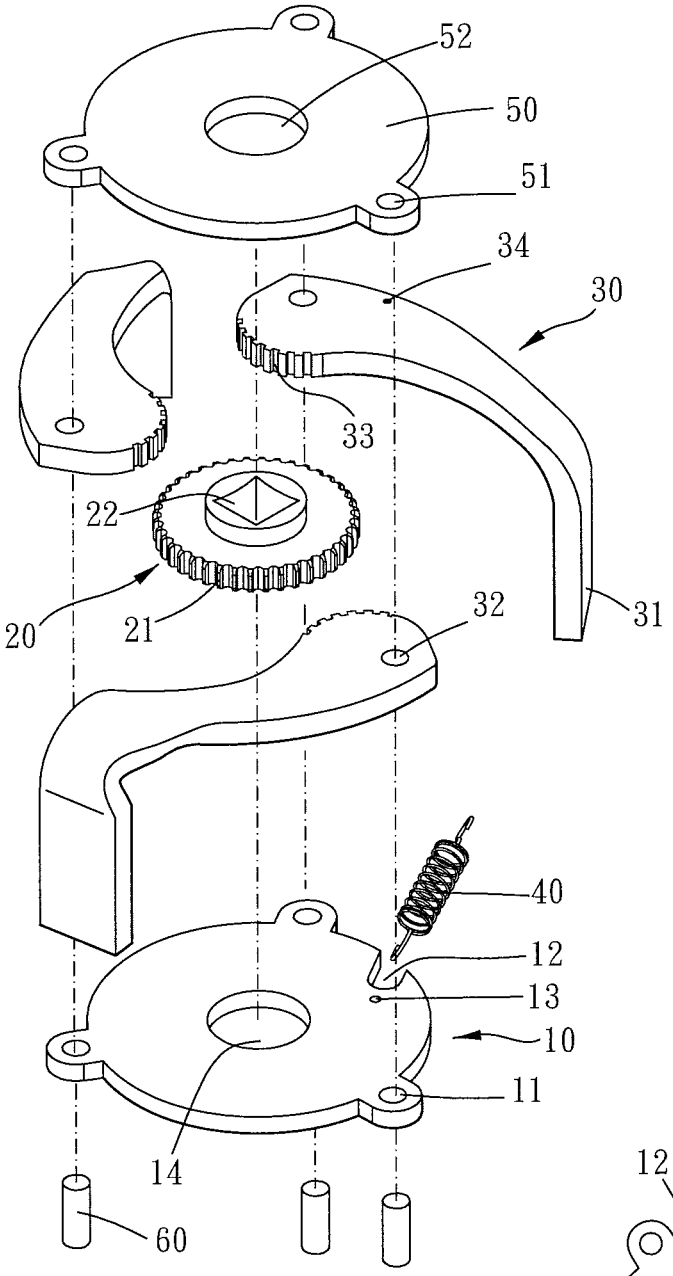
FIG. 1 is a breakdown drawing of the present invention.
Figure 1A:
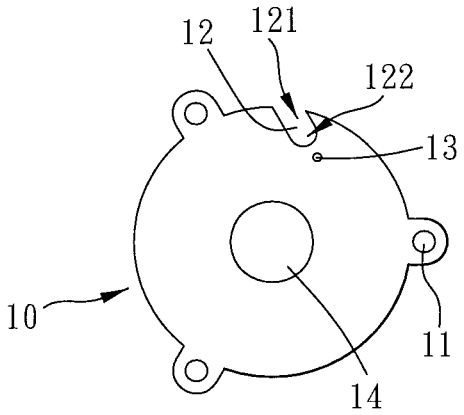
FIG. 1A is a top view of a main body of the present invention.
Figure 2:
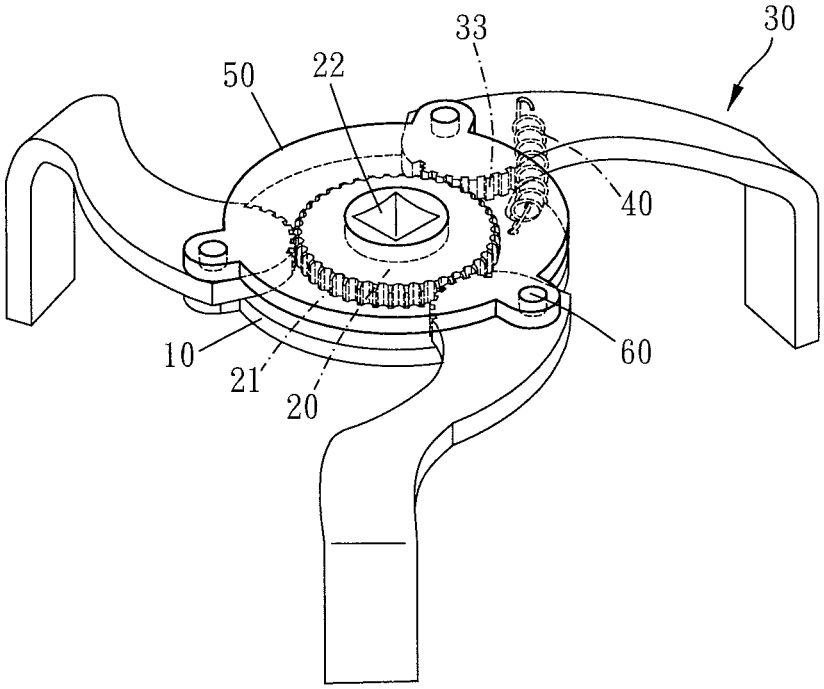
FIG. 2 is a stereogram of the present invention.
Figure 3:
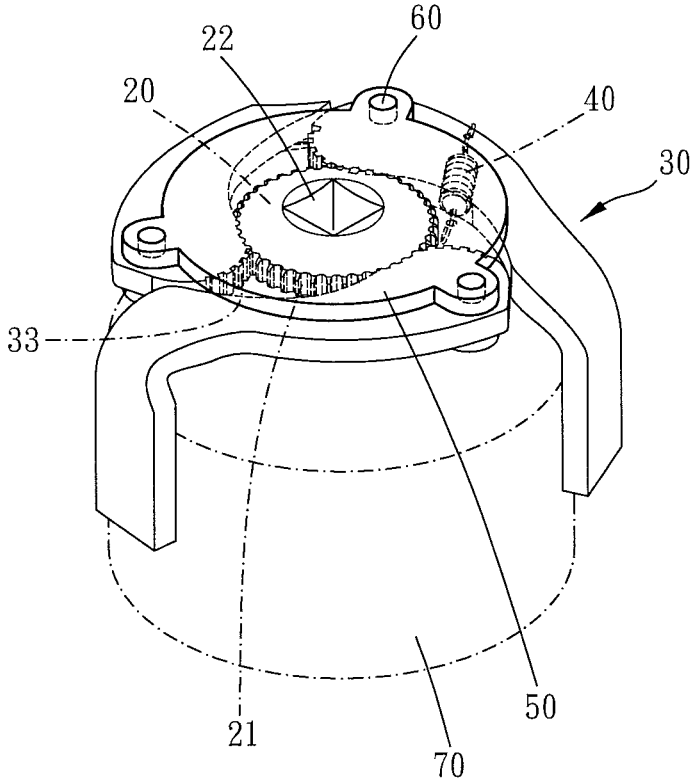
FIGS. 3 and 4 are illustrations of the present invention.
Figure 4:
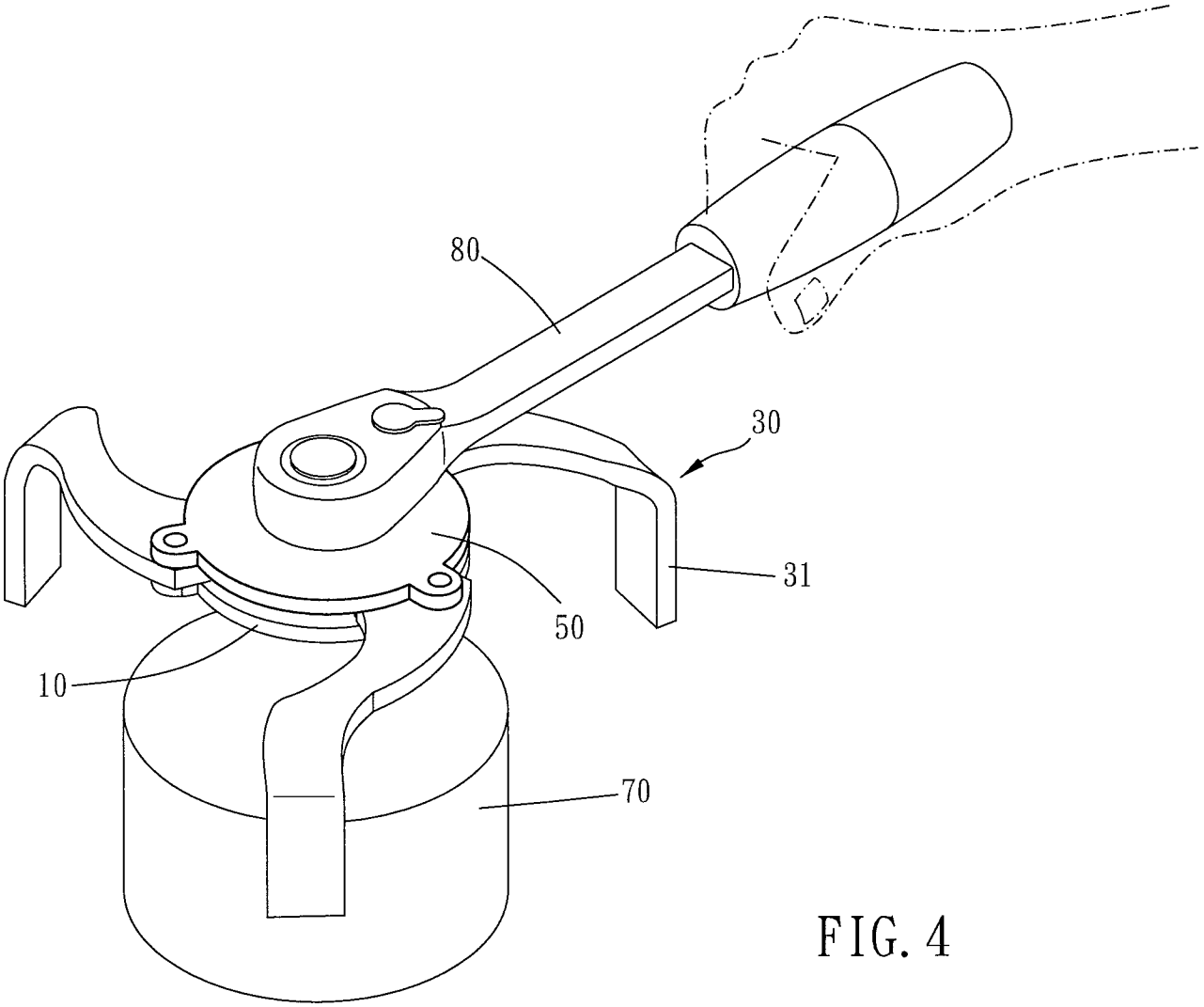

Please refer to FIG. 1 to FIG. 4 and FIG. 1A, the oil filter remover of the present invention includes a main body 10, a toothed element 20, at least three claw elements 30, and an elastic element 40.

The main body 10 defines a center. The main body 10 has at least three first pivot portions arranged spacedly at a periphery thereof. The main body 10 further has at least one first connecting portion located between two adjacent ones of the first pivot portions. The toothed element 20 is rotatably arranged at the center of the main body 10. The toothed element 20 is faulted with an annular toothed portion 21 around a periphery thereof. The toothed element 20 further has a driving portion for a tool to connect with. Each claw element 30 has a bent clamping portion 31 at an end thereof and a second pivot portion at an other end thereof. The second pivot portions are pivotally connected to the first pivot portions respectively. Each claw element 30 has a toothed portion 33 beside the second pivot portion. The toothed portions 33 are engaged with the annular toothed portion 21 respectively. At least one of the claw elements 30 further has a second connecting portion located between the clamping portion 31 and the second pivot portion. The clamping portions 31 enclose a clamping space. Two opposite ends of the elastic element 40 are connected to the first connecting portion and the second connecting portion respectively so that the claw elements 30 tend to pivot toward the main body 10.

In the present embodiment, the oil filter remover of the present invention includes three said claw elements 30. The main body 10 has three said first pivot portions. The main body 10 is substantially circle. The center of the main body 10 is defined as a center of circle. The first connecting portion includes a receiving groove 12 and a first hook hole 13. The receiving groove 12 elongatedly extends from the periphery of the main body 10 along a first chord. The receiving groove 12 has a first end 121 at the periphery of the main body 10 and an opposite second end 122. The first hook hole 13 is located beside the second end 122 of the receiving groove 12. The elastic element 40 is a spring and is at least partially received in the receiving groove 12. The second connecting portion is a second hook hole 34. An end of the elastic element 40 is hooked to the first hook hole 13, and an other end of the elastic element 40 is hooked to the second hook hole 34.

Furthermore, a length of the first chord is 0.84~0.92 times an external diameter of the main body 10. A distance between the first end 121 and the second end 122 of the receiving groove 12 is 0.18~0.26 times the external diameter of the main body 10. A distance from the first end 121 of the receiving groove 12 to the first pivot portion adjacent to said receiving groove 12 is 0.2~0.28 times the external diameter of the main body 10. The claw element 30 which said first pivot portion is connected to having the second connecting portion. A distance between the second pivot portion and the second connecting portion is 0.2~0.28 times the external diameter of the main body 10.

Besides, the oil filter remover of the present invention further includes a top cover 50. The toothed element 20 and the first pivot portions of the claw elements 30 are sandwiched by the top cover 50 and the main body 10. The toothed element 20 partially extends outside the top cover 50. The first pivot portion extends outward from the periphery of the main body 10 and has a first pivot hole 11. Each second pivot portion has a second pivot hole 32. The top cover 50 has third pivot holes 51 corresponding to the first pivot holes 11. A pivot pin 60 is inserted through each first pivot hole 11, the corresponding second pivot hole 32, and the corresponding third pivot hole 51. More specifically, the toothed element 20 has a protrusion at each of a top and a bottom thereof. The top cover 50 has a through hole 52 at a center thereof. The main body 10 has a through hole 14 at the center thereof. The two protrusions are inserted through the two through holes 14,52 respectively. The driving portion of the toothed element 20 includes a driving hole 22. The diving hole 22 penetrates the two protrusions.

In use, the user can utilize a tool 80 such as a wrench to rotate the toothed element 20. When the toothed element 20 is rotated, the claw elements 30 are pivoted outward to enlarge the clamping space. Thus, the oil filter remover can be disposed on an oil filter 70 now. When the oil filter remover is disposed on the oil filter 70, the user can release the tool 80 so that the claw element 30 connected to the elastic element 40 is pulled back by the elastic element 40. As a result, the toothed element 20 is rotated by the claw element 30 connected to the elastic element 40, so the other claw elements 30 are also pulled back. Thus, the claw elements 30 constantly clamp the oil filter 70 even if the tool is removed. Thereby, the operation becomes easier and quicker. In addition, the oil filter remover is constantly packed to be easy to store.

Figure 6:
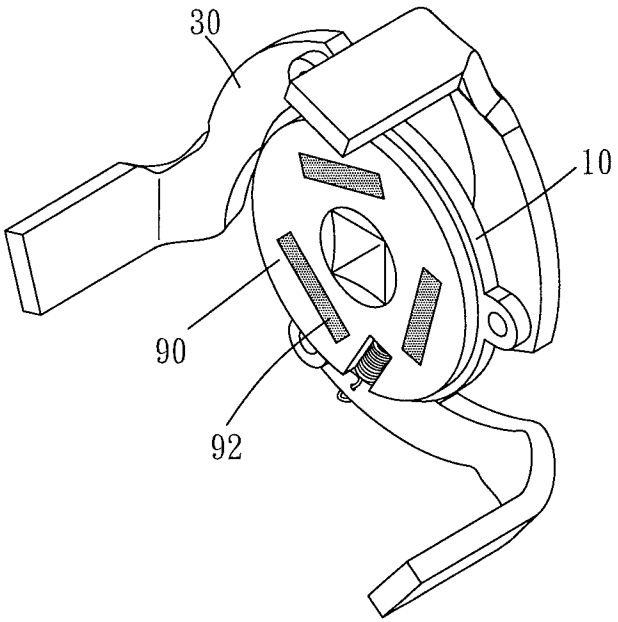
FIG. 6 is a stereogram showing a second embodiment of the present invention.
Figure 5:
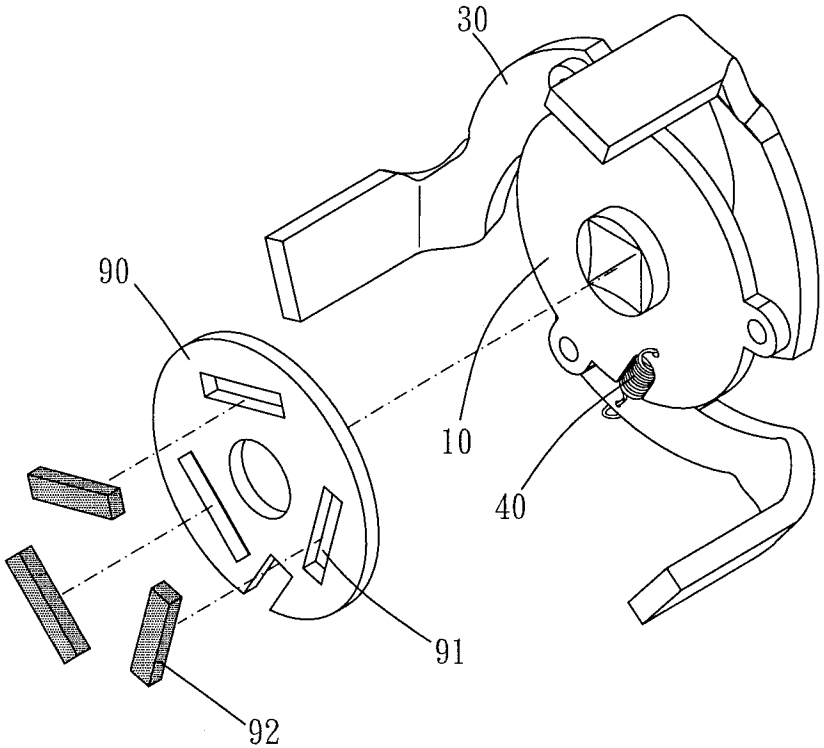
FIG. 5 is a breakdown drawing showing a second embodiment of the present invention.

In the second embodiment of the present invention, as shown in FIGS. 5 and 6, the oil filter remover can further include a magnetic element 90. The magnetic element 90 is disposed on a bottom of the main body 10. The magnetic element 90 has at least one slot 91 and includes at least one magnetic piece 92. The magnetic piece 92 is embedded in the slot 91. Thus, the magnetic piece 92 helps pull the oil filter upward to facilitate removal of the oil filter.

What is claimed is:

1. An oil filter remover, including:

a main body, defining a center, the main body having at least three first pivot portions arranged spacedly at a periphery thereof, the main body further having at least one first connecting portion located between two adjacent ones of the first pivot portions, the first connecting portion including a receiving groove penetrating the main body axially, the receiving groove elongatedly extending from the periphery of the main body along a first chord, the receiving groove having a first end at the periphery of the main body and an opposite second end, the first end of the receiving groove being separated from the first pivot portions along the periphery of the main body;

a toothed element, rotatebly arranged at the center of the main body, the toothed element being formed with an annular toothed portion around a periphery thereof, the toothed element further having a driving portion for a tool to connect with;

at least three claw elements, each claw element has a bent clamping portion at an end thereof and a second pivot portion at an other end thereof, the second pivot portions being pivotally connected to the first pivot portions respectively, each claw element having a toothed portion beside the second pivot portion, the toothed portions being engaged with the annular toothed portion respectively, at least one of the claw elements further having a second connecting portion located between the clamping portion and the second pivot portion, the clamping portions enclosing a clamping space;

an elastic element, the elastic element being at least partially received in the receiving groove, two opposite ends of the elastic element being connected to the second end of the first connecting portion and the second connecting portion respectively so that the claw elements tend to pivot toward the main body, an extension direction of the elastic element traversing an extension direction of the claw element.

2. The oil filter remover of claim 1, including three said claw elements, the main body having three said first pivot portions, the main body being substantially circle, the center of the main body being defined as a center of circle, the first connecting portion further including a first hook hole, the first hook hole being located beside the second end of the receiving groove, the elastic element being a spring, the second connecting portion being a second hook hole, an end of the elastic element being hooked to the first hook hole, an other end of the elastic element being hooked to the second hook hole.

3. The oil filter remover of claim 2, wherein a length of the first chord is 0.84~0.92 times an external diameter of the main body.

4. The oil filter remover of claim 3, wherein a distance between the first end and the second end of the receiving groove is 0.18~0.26 times the external diameter of the main body.

5. The oil filter remover of claim 4, wherein a distance from the first end of the receiving groove to the first pivot portion adjacent to said receiving groove is 0.2~0.28 times the external diameter of the main body, the claw element which said first pivot portion is connected to having the second connecting portion, a distance between the second pivot portion and the second connecting portion is 0.2~0.28 times the external diameter of the main body.

6. The oil filter remover of claim 1, further including a top cover, the toothed element and the first pivot portions of the claw elements being sandwiched by the top cover and the main body, the toothed element partially extending outside the top cover.

7. The oil filter remover of claim 6, wherein the first pivot portion extends outward from the periphery of the main body and has a first pivot hole, each second pivot portion has a second pivot hole, the top cover has third pivot holes corresponding to the first pivot holes, a pivot pin is inserted through each first pivot hole, the corresponding second pivot hole, and the corresponding third pivot hole.

8. The oil filter remover of claim 6, wherein the toothed element has a protrusion at each of a top and a bottom thereof, the top cover has a through hole at a center thereof, the main body has a through hole at the center thereof, the two protrusions are inserted through the two through holes respectively, the driving portion of the toothed element includes a driving hole, the driving hole penetrates the two protrusions.

9. The oil filter remover of claim 2, further including a magnetic element, the magnetic element being disposed on a bottom of the main body, the magnetic element having a plurality of slots and including a plurality of magnetic pieces, each of the slots being separated from a center of the magnetic element along a radial direction of the magnetic element, the slots being equally-spaced arranged around the center of the magnetic element, the magnetic pieces being embedded in the slot respectively, each of the magnetic pieces being at a radial direction same with one of the first pivot portions, the magnetic element being further formed with a spring groove penetrating therethrough, the spring groove overlapping the receiving groove to receive the elastic element.

* * * * *